US005732911A

United States Patent [19]

Kulp et al.

[11] Patent Number: 5,732,911

[45] Date of Patent: Mar. 31, 1998

[54] LEGLESS SIGN STAND

[75] Inventors: Jack H. Kulp, San Juan Capistrano; Samuel J. Bechtle, Mission Viejo, both of Calif.; Frank G. Cain, Highland Village, Tex.

[73] Assignee: Traffix Devices, Inc., San Clemente, Calif.

[21] Appl. No.: 642,659

[22] Filed: May 3, 1996

[51] Int. Cl.[6] ..... G09F 15/00

[52] U.S. Cl. ..... 248/158; 40/607; 40/610; 248/292.12; 248/397; 248/633

[58] Field of Search ..... 248/158, 166, 248/176.1, 188.6, 291.1, 292.12, 632, 633, 397, 188.1; 40/607, 610

[56] References Cited

U.S. PATENT DOCUMENTS

| | | | |
|---|---|---|---|
| 2,887,983 | 5/1959 | Budd | 40/610 X |
| 3,235,214 | 2/1966 | Sprung | 248/158 |
| 3,397,771 | 8/1968 | Sullivan et al. | 248/633 X |
| 3,847,335 | 11/1974 | Ross | 248/166 |
| 4,099,771 | 7/1978 | Mathews | 248/158 X |
| 4,273,213 | 6/1981 | Munz | 248/633 X |
| 4,318,238 | 3/1982 | Macarle, Jr. | 40/607 |
| 4,718,624 | 1/1988 | Greulich | 248/158 |
| 4,744,536 | 5/1988 | Bancalari | 248/166 X |
| 4,889,067 | 12/1989 | Provence, Jr. | 248/910 X |
| 4,980,984 | 1/1991 | Kulp et al. . | |
| 5,082,221 | 1/1992 | Lai | 248/168 |
| 5,267,523 | 12/1993 | Hugron | 40/607 X |
| 5,318,258 | 6/1994 | Lang | 248/166 |

*Primary Examiner*—Derek J. Berger

[57] ABSTRACT

A legless sign stand includes a rubber base having an upper planar surface and a lower planar surface. A first rigid planar member contacts the upper planar surface of the rubber base, and a second rigid planar member contacts the lower planar surface of the rubber base. Both of the rigid planar members are secured to the rubber base with bolts. Two support brackets are mounted to the first rigid planar member, and a support mast is connected between the two support brackets. The support mast accommodates a clamping member, which is adapted for clamping onto a portion of the highway traffic sign to thereby support the highway traffic sign above a horizontal support surface.

25 Claims, 4 Drawing Sheets

A2
A3
11
11

LEGLESS SIGN STAND

FIELD OF THE INVENTION

The present invention relates generally to highway signs, and more particularly, to a legless sign stand for ballasting a highway traffic sign above a horizontal support surface.

BACKGROUND OF THE INVENTION

Highway signs are generally used for promoting the safe passage of motor vehicles and/or pedestrians. These highway signs help to advise people of, for example, approaching unsafe driving conditions, and are generally provided with various highway legends. Although highway signs are generally configured to flex in response to prevailing winds and wind gusts created by motor vehicles and the like, a prior art highway sign may tip over or move slightly along a supporting surface under the influence of high winds.

Ballasting devices may be used with highway signs to prevent undesirable influences on the signs resulting from wind gusts, for example. One such ballasting device involves the placement of one or more sandbags at the base of the highway traffic sign. Although these sandbags may function to hold the sign in place, they also have several drawbacks. Many applications require at least two of the sandbags to be placed against the stand of the highway traffic sign. Each sandbag may weigh between 35 and 50 pounds. The sandbags must first be filled, and then transported and positioned in place on the highway signs at the job site. This task is manually intensive and significantly adds to the time and labor for setting up the highway signs. The sandbags are seldom filled to consistent weights, and the amount of sand used for ballasting often will be either insufficient or excessive. Sandbags are also susceptible to breakage and the potential danger of loose sand on the roadway. It has been found that sand on a dry driving pavement reduces the coefficient of friction between a tire and the road surface, which results in increasing emergency deceleration distances.

Many sign stands comprise three or four legs for supporting the sign above a horizontal surface. Each of the legs generally extends radially and downwardly from a center of the sign stand. These leg configurations for sign stands may not adequately protect the sign from moving about or tipping over in high wind conditions. Additionally, the supporting legs of such a sign stand are susceptible to damage when impacted by passing automobiles or the like. A need has existed in the prior art for a low profile sign stand which is both simple in construction and durable.

SUMMARY OF THE INVENTION

The legless sign stand of the present invention provides a sturdy ballasting function and is simple in design. The legless sign stand can be prefabricated of recycled materials to required dimensions and weights, and can be transported with relative ease when not attached to a highway traffic sign. The rubber portion is preferably formed from vulcanized reclaimed rubber. Even when the legless sign stand is attached to a highway traffic sign, the entire apparatus may be readily moved without any need for disassembly. In contrast, prior art devices using sandbags may require removal of the sandbags before transportation of the sign and sign stand, and subsequent repositioning of the sandbags onto the highway sign base. Since the legless sign stand of the present invention does not use sand, dangers associated with loose sand on a driving surface are attenuated.

Additionally, the legless sign stand of the present invention is not susceptible to substantial damage resulting from an impact with an automobile, for example. An automobile wheel passing over a four legged sign base would likely render the sign base inoperable, but the same trauma subjected to the legless sign base of the present invention would likely result in minimal damage.

The legless sign stand of the present invention includes a rubber base having an upper planar surface and a lower planar surface. A first rigid planar member contacts the upper planar surface of the rubber base, and a second rigid planar member contacts the lower planar surface of the rubber base. Both of the rigid planar members are secured to the rubber base with bolts. Two support brackets are mounted to the first rigid planar member, and a support mast is connected between the two support brackets. The support mast accommodates a clamping member, which is adapted for clamping onto a portion of the highway traffic sign to thereby support the highway traffic sign above a horizontal support surface.

The two rigid planar members are formed of metal sheets. The upper rigid planar member may be rectangularly shaped with each of the four corners bent in a downward direction into the rubber base to reduce the possibility of tire damage, for example.

The support mast is pivotally held between the two support brackets. The support mast can be pivoted between a first position where the support mast is oriented perpendicularly relative to the planar surface of the rubber base, and a second position where the support mast is oriented parallel relative to the planar surface of the rubber base. A pivot pin running through each of the two support brackets and the support mast facilitates this pivoting action.

According to one broad feature of the present invention, only a single rigid planar member is secured to the rubber base. The rigid planar member is secured to the rubber base beneath the upper planar surface of the rubber base. A perimeter of the rigid planar member is covered by a perimeter lip of the rubber base. Thus, a bottom surface of the rigid planar member contacts a surface of the rubber base beneath the upper planar surface, and an upper surface near the perimeter of the rigid planar member is contacted by the perimeter lip of the rubber base.

According to another broad aspect of the present invention, the two support brackets have rounded upper surfaces. Each of the rounded upper surfaces has a first notch for accommodating a latch bar of the support mast when the support mast is oriented perpendicularly relative to the planar surface of the rubber base, and a second notch for accommodating the latch bar when the support mast is oriented parallel relative to the planar surface of the rubber base.

The rubber base includes four stacking lugs protruding above the upper planar surface of the rubber base to facilitate stacking of one legless sign stand on top of another legless sign stand. To further facilitate such stacking, a recessed channel is disposed below the lower planar surface of the rubber base for accommodating the support mast when the support mast is in the storage orientation. The channel extends beneath the two support brackets to thereby facilitate compact stacking by accommodating the two support brackets of a second legless sign stand therebeneath.

The present invention, together with additional features and advantages thereof, may best be understood by reference to the following description taken in connection with the accompanying illustrative drawings.

DETAILED DESCRIPTION OF THE PREFERRED EMBODIMENTS

Figure 1:
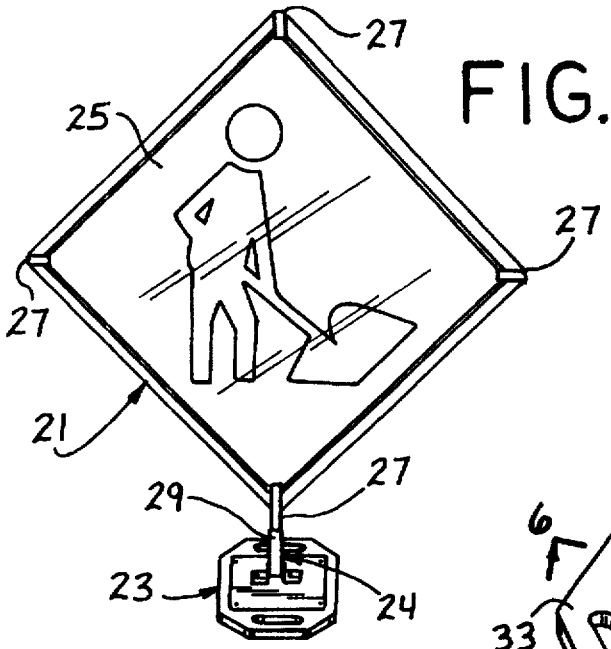
FIG. 1 is a perspective view of the legless sign stand and highway traffic sign according to a first preferred embodiment of the present invention.

Turning to FIG. 1, a highway traffic sign 21 is shown supported above a horizontal support surface by a legless sign stand 23. The highway traffic sign 21, in one preferred construction (as disclosed, for example, in U.S. Pat. No. 4,980,984) comprises a flexible material 25 and four flexible corner pockets 27 located at each of the corners of the highway traffic sign 21. Each of the four flexible corner pockets 27 accommodates a respective end of two battens (not shown) located behind the flexible material 25. A vertical batten runs between the top corner pocket 27 and the bottom corner pocket (not shown), and a horizontal batten runs between the two side corner pockets 27.

The legless sign stand 23 comprises a latch bracket 24, which includes a support mast 29, for accommodating a corner pocket 27. The sign support mast 29 of the legless sign stand 23 preferably grips the bottom corner pocket and a portion of the vertical batten (not shown), to thereby hold the traffic sign 21 in an upright orientation. Alternatively, the traffic sign 21 may be supported using bolts passing through both the vertical batten and an upright member (not shown) of simple construction, used in place of the sign support mast 29 and/or the corner pocket 27.

Figure 2:
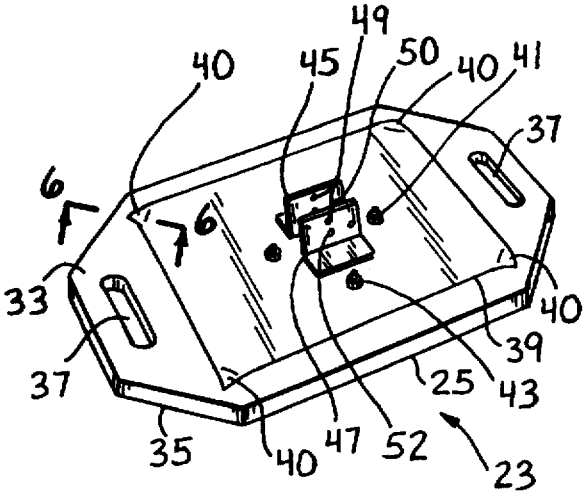
FIG. 2 is a perspective view of the legless sign stand illustrated in FIG. 1.

As shown in FIG. 2, the legless sign stand 23 comprises a rubber base 25 having two handle apertures 37 located therein. Each of the handle apertures 37 can be gripped by the hand of a user, or a tool, to facilitate transportation or repositioning of the rubber base 25. The handle apertures 37 may also facilitate repositioning of the legless sign stand 23 when a highway traffic sign 21 is attached thereto.

An upper metal plate 39 is secured to the top base surface 33 via bolts 41 and nuts 43. A first support bracket or ear 45 and a second support bracket or ear 47, which also comprise a portion of the latch bracket 24, are secured to the upper metal plate 39, preferably by welding. Each of the first support bracket 45 and the second support bracket 47 preferably comprises a shear bolt aperture 49, a shear bolt storage position aperture 50, and a pivot pin aperture 52. These apertures 49, 50, and 52 are used for securing the support mast 29 between the two support brackets 45, 47, as discussed below with reference to FIGS. 4 and 5.

Figure 3:
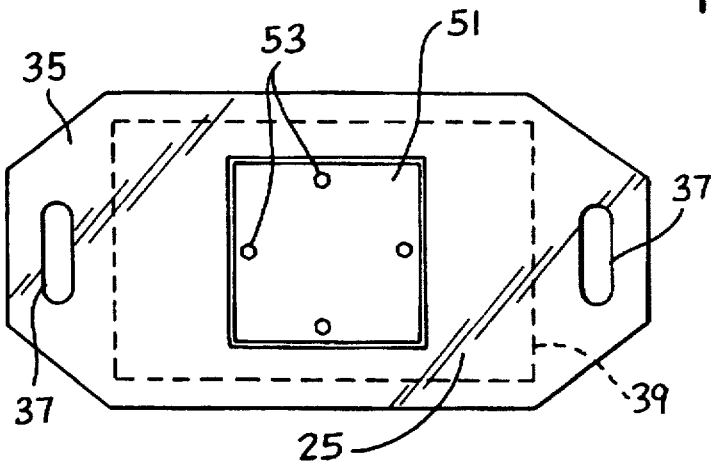
FIG. 3 is a bottom planar view of the legless sign stand illustrated in FIG. 1.

As shown in FIG. 3, the bottom base surface 35 of the rubber base 25 comprises a lower metal plate 51, which is secured to the rubber base 25 using the same bolts 41 and nuts 43 used to secure the upper metal plate 39 to the rubber base 25. The bolt heads 53 preferably contact the lower metal plate 51, and the nuts 43 preferably contact the upper metal plate 39 (FIG. 2). The lower metal plate 51 permits easy mechanical attachment of the upper metal plate 39 and, additionally, adds rigidity to the rubber base 25. In the presently preferred embodiment, the surface area of the upper metal plate 39 is larger than the surface area of the lower metal plate 51. The large surface area of the upper metal plate 39 provides stiffness to the rubber base 25 to thereby prevent the rubber base 25 from bowing and bending in high wind conditions when the highway traffic sign is secured to the legless sign stand 23. In an alternative embodiment, the upper metal plate 39 or the lower metal plate 51, or both, may be omitted. When the upper metal plate 39 is omitted, the two support brackets 45, 47 may be secured via bolts passing directly therethrough and into the rubber base 25. As another alternative embodiment, the size of either the upper metal plate 39 or the lower metal plate 51, or both, may be changed. For example, a smaller sized upper metal plate 39 may be used in combination with a larger sized lower metal plate 51.

Figure 4:
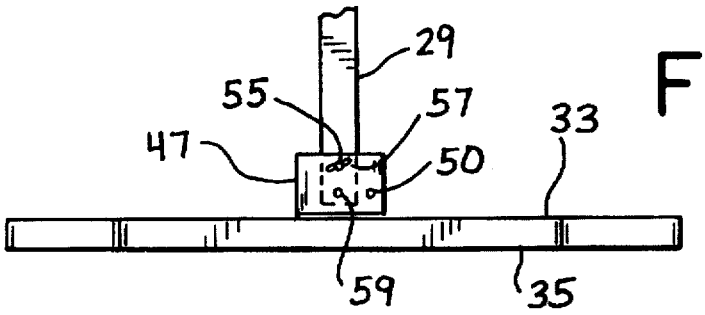
FIG. 4 is a side elevational view of the legless sign stand illustrated in FIG. 1.
Figure 5:
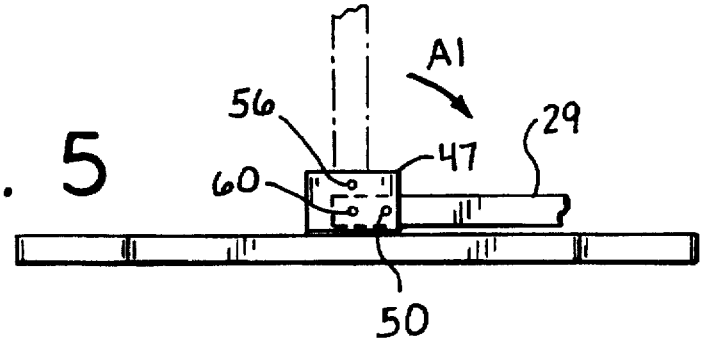
FIG. 5 is a side elevational view of the legless sign stand of FIG. 1 in a storage orientation.

FIG. 4 illustrates a pivot pin 59 and a bolt 55 for securing the support mast 29 between the first support bracket 45 and the second support bracket 47. The pivot pin 59 is preferably permanently secured through the pivot pin apertures 52 and the support brackets 45, 47, and through two apertures (not shown) in the support mast 29. The bolt 55 is preferably removably secured, via a wing nut 57, through the two bolt apertures 49 and two apertures (not shown) in the support mast 29. In the presently preferred embodiment, the shear strength of the pivot pin 59 is greater than the shear strength of the bolt 55, so that the bolt 55 will shear upon impact by an automobile, for example, to allow the support mast 29 to pivot about the pivot pin 59 in the direction of the arrow A1 (FIG. 5). The pivoting of the support mast 29 in the direction of the arrow A1 may minimize damage to the legless sign stand 23, and may further prevent damage to the undercarriage of the automobile. The shear bolt 55 may be removed in normal operating conditions to pivot the support mast 29 about the pivot pin 59 into a storage orientation generally parallel with the plane of the rubber base 25, as shown in FIG. 5. In this storage orientation, the shear bolt 55 and wing nut 57 can be reinserted through the apertures 50 and two apertures (not shown) in the support mast 29, thereby locking the support mast 29 in the storage orientation.

Figure 6:
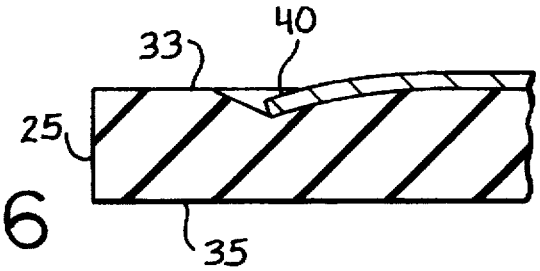
FIG. 6 is cross-sectional view, taken along lines 6—6, of a portion of the legless sign stand shown in FIG. 2.

FIG. 6 is a cross-sectional view of the rubber base 25 and the upper metal plate 39 shown in FIG. 2, taken along the line 6, 6. Each of the four corners 40 of the upper metal plate 39 is preferably bent downward. In the presently preferred embodiment, each of the corners 40 of the upper metal plate 39 is bent before attachment to the rubber base 25. When the bolts 41 and nuts 43 are tightened, each of the corners 40 bites into the top base surface 33. The corners 40 are thus disposed beneath a plane of the top base surface 33 to prevent the potentially harmful corners 40 from damaging tires of automobiles, for example.

Figure 7:
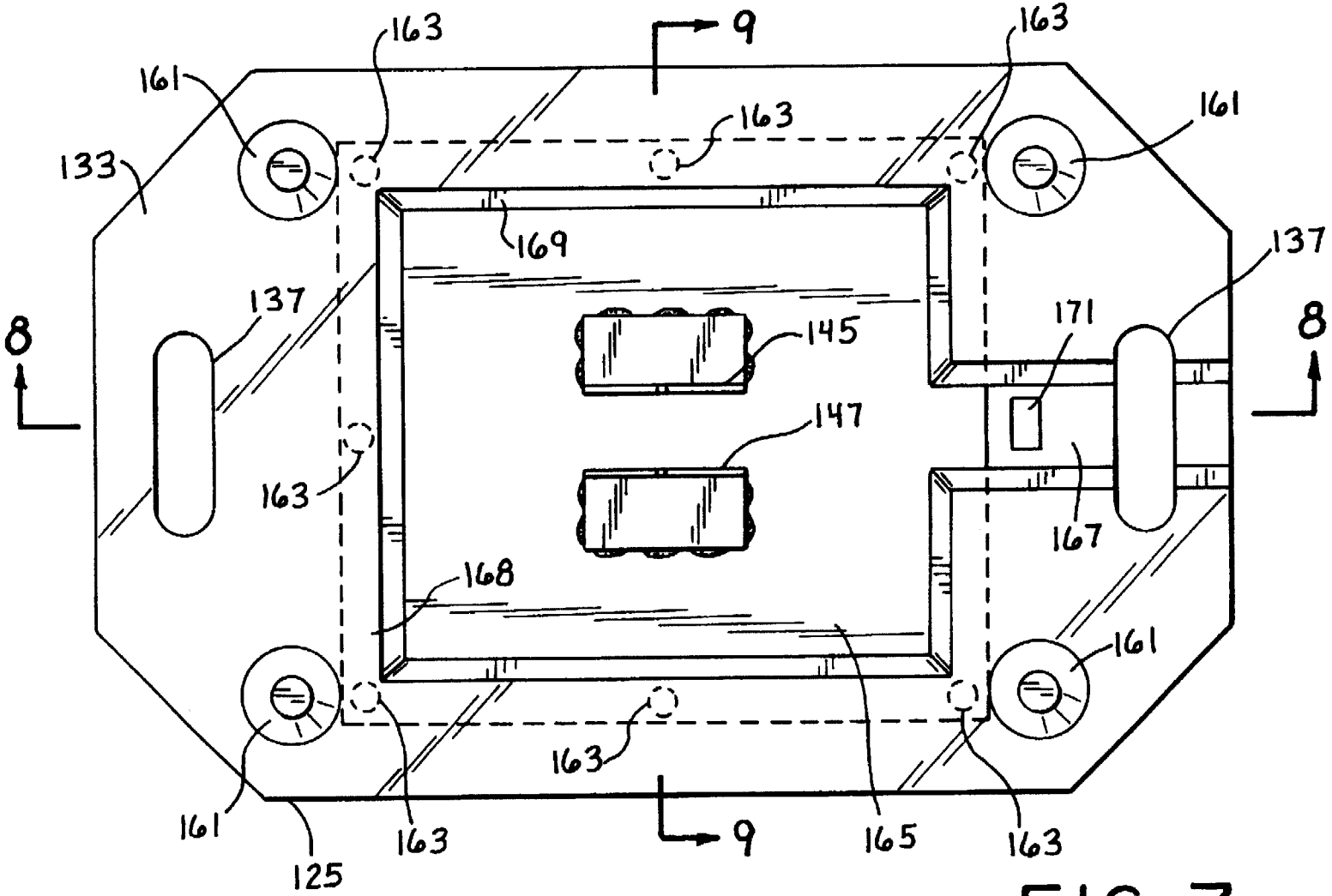
FIG. 7 is a top planar view of the legless sign stand according to a second preferred embodiment of the present invention.

A second preferred embodiment of the present invention is shown in FIG. 7. The rubber base 125 comprises a top base surface 133 and a bottom base surface 135. Two handle apertures 137 are formed on opposing sides of the rubber base 125. As with the embodiment described with reference to FIGS. 1–6 above, the rubber base preferably comprises vulcanized reclaimed rubber, "crumb" rubber, or bonded "crumb" rubber. Four stacking lugs 161 protrude above the top base surface 133 and, preferably, are integrally molded with the rubber base 125. The rubber base 125 further comprises a recessed area for accommodating a recessed metal plate 165. The recessed metal plate 165 is preferably rectangular, and rests in a plane beneath a plane defined by the top base surface 133. A perimeter lip, which is preferably integrally molded with the rubber base 125, surrounds and covers an upper portion of the recessed metal plate 165 along the four sides of the recessed metal plate 165. Preferably, the metal plate 165 is molded into the base i.e. "overmolded" during the base fabrication process.

Figures 8, 10, 11:
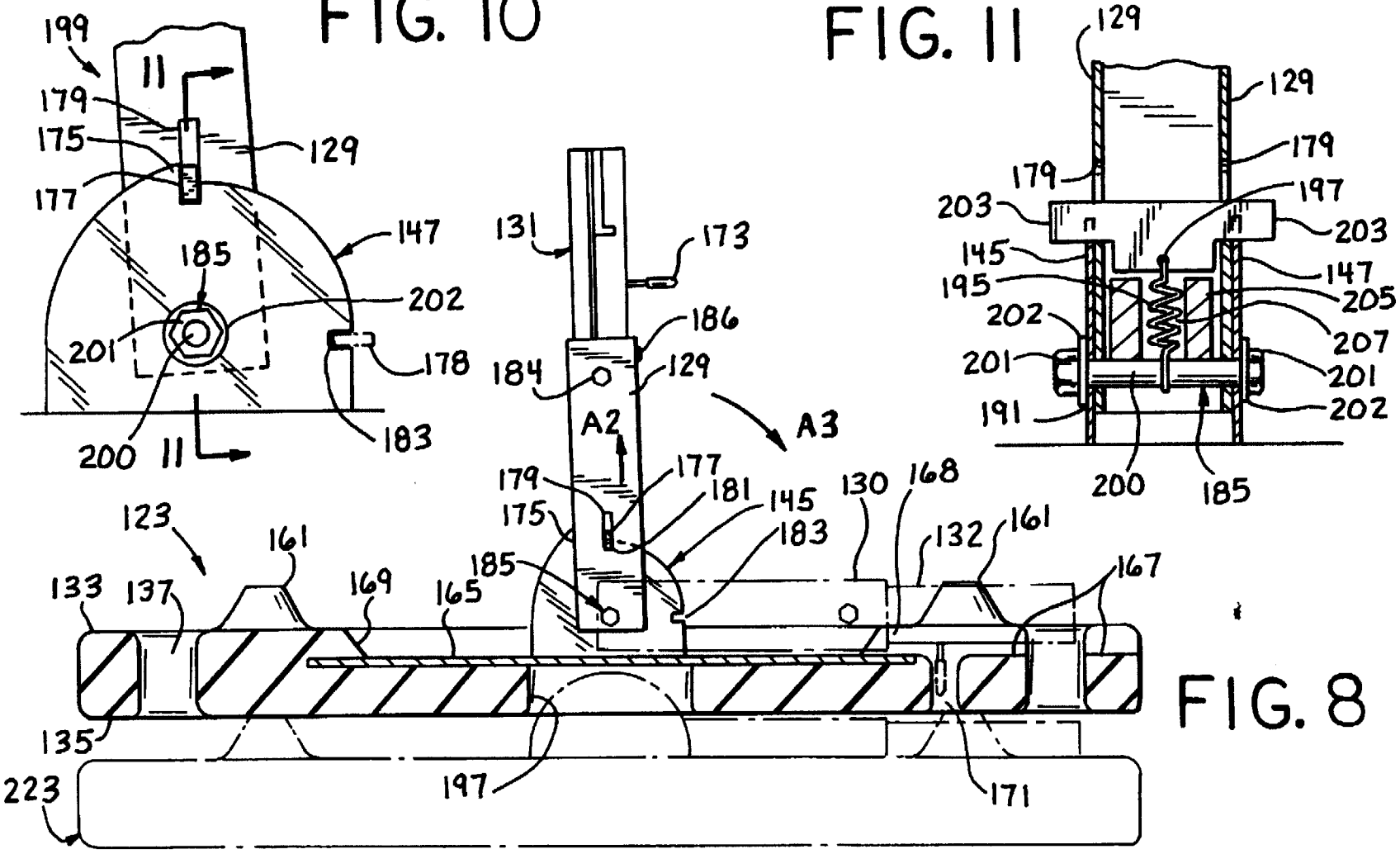
FIG. 8 is a first cross-sectional view, taken along lines 8—8, of the legless sign stand shown in FIG. 7.
FIG. 10 is a side elevational view of the sign supporting mechanism of the legless sign stand according to the second preferred embodiment.
FIG. 11 is a cross-sectional view, taken along lines 11—11, of a portion of the sign supporting mechanism shown in FIG. 10.

A plurality of large apertures 163 (eight in the preferred embodiment) are formed through the recessed metal plate 165. These apertures function to mechanically attach the rubber base 125 and the metal plate 165, because during the overmodling process, rubber flows through each of the apertures 163 and sets in place during the subsequent curing step. A first rounded support bracket or ear 145 and a second rounded support bracket or ear 147 are secured to the recessed metal plate 165, preferably by welding. The two support brackets 145, 147 pivotally support a support mast 129 (FIG. 8). A plane defined by the recessed metal plate 165 is extended through the recessed channel surface 167, and a latch bracket handle accommodating aperture 171 is formed through the rubber base 125 within the recessed channel surface 167.

A cross-sectional view of the legless sign stand 123, taken along the line 8, 8 of FIG. 7 is shown in FIG. 8. As shown in FIG. 8, each of the handle apertures 137, and the latch bracket handle accommodating aperture 171, preferably extend from the top base surface 133 and recessed channel surface 167 to the bottom base surface 135. The four edges of the periphery lip of the rubber base 125 are preferably chamfered. This chamfer 169 surrounding the peripheral lip 168 may be formed during the initial molding of the rubber base 125, or may be subsequently machined.

Each of the first rounded support bracket 145 and the second rounded support bracket 147 comprises a rounded top portion, and further comprises a first locking notch 181 and a second locking notch 183. The support mast 129 is secured between the first rounded support bracket 145 and the second rounded support bracket 147 with a pivot pin 185, similarly to the embodiment discussed above with reference to FIG. 4. In the preferred embodiment, each of the rounded support brackets 145 is asymmetrical, in that it includes a raised back stop portion 175 on a side of the first locking notch 181 which is opposite to that of the second locking notch 183.

A latch bar 177 within the support mast 129 is biased by a spring 195 (FIG. 11) toward the pivot pin 185. The latch bar 177 may be moved in the direction of the arrow A2 out of the first locking notch 181. The support mast 129 is no longer secured in an upright orientation when the latch bar 177 is moved in the direction of the arrow A2 out of the first locking notches 181. The support mast 129 may be rotated about the pivot pin 185 in the direction of the arrow A3 to a storage orientation, which is substantially parallel with a plane of the recessed metal plate 165. The sign latch bracket 131, which is preferably secured to the support mast 129 with two bolts 184, 186, is also aligned parallel with the plane of the recessed metal plate 165, and the bracket handle 173 fits into the bracket handle accommodating aperture 171. The support mast 129 and sign latch bracket 131 are shown in phantom positioned parallel to the plane of the recessed metal plate 165, by the reference numbers 130 and 132, respectively. Importantly, the mast 129 is prevented from pivoting in the direction opposite to that of arrow A3 by the back stop portion 175, which is raised sufficiently that the latch bar 177 cannot be pivoted above it, so as to clear it.

As shown in FIG. 8, when the support mast 129 and sign latch bracket 131 are oriented in a plane parallel to the recessed metal plate 165, the support mast 129 and the sign latch bracket 131 do not extend above a plane formed by the tops of the four stacking lugs 161. Thus, the support mast 129 and the sign latch bracket 131 can be pivoted in the direction of the arrow A3 to rest beneath a plane formed by the four stacking lugs 161 to thereby facilitate compact storage. A second legless sign stand 223 is shown in phantom in FIG. 8 beneath the first legless sign stand 123. The first legless sign stand 123 is stacked on top of the second legless sign stand 223 such that the four stacking lugs 261 of the second legless sign stand 223 contact the bottom base surface 135 of the legless sign stand 123. A recessed area 197 of the legless sign stand 123 accommodates a first rounded support bracket 245 and a second rounded support bracket 247 of the second legless sign stand 223.

Figure 9:
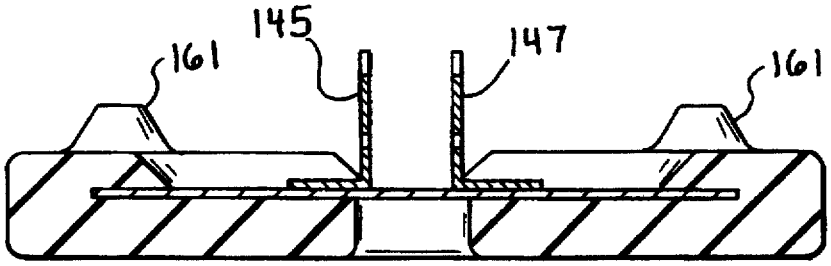
FIG. 9 is a second cross-sectional view, taken along lines 9—9, of the legless sign stand shown in FIG. 7.

A cross-sectional view of the legless sign stand 123 shown in FIG. 7, taken along the line 9, 9, is illustrated in FIG. 9. The first rounded support bracket 145 and the second rounded support bracket 147 protrude above a plane formed by the four supporting lugs 161, but compact storage is facilitated by the recessed area 197 of another legless sign stand. The sign supporting mechanism 199 shown in FIG. 10 comprises the first rounded support bracket 145 (FIG. 7) and the second rounded support bracket 147. The pivot pin 185, secured within the two rounded support brackets 145, 147, comprises a bolt 200, an elastic stop nut 201, and two flat washers 202. A cross section of this sign supporting mechanism 199, taken along the line 11, 11 of FIG. 10, is shown in FIG. 11. The latch bar 177 comprises two outer ends 203, which protrude through two corresponding latch apertures 179. The latch apertures 179 allow the two outer ends 203 to move vertically therein. The spring 195 is connected to the latch bar 177 via an aperture 197, and is also connected to the pivot pin 185. The spring 195 biases the latch bar 177 toward the pivot pin 195. A latch bar centering plug 205, preferably comprising plastic or metal and having an outside diameter slightly less than the inside dimension of the support mast 129 is preferably provided to center the latch bar 177 in the apertures 179. The plug 205 includes a center core 207 which is large enough to accommodate the spring 195. A user may grip the two outer ends 203 of the latch bar 177 to pull the latch bar in a direction away from the pivot pin 185 to facilitate rotation of the support mast 129 (FIG. 8) in the direction of arrow A3. In the presently preferred embodiment, the shear strength of the latch bar 177 is less than the shear strength of the pivot pin 185, so that the latch bar 177 will shear upon impact by an automobile, for example, to allow the support mast 129 to pivot about the pivot pin 185 in the direction of the arrow A3 (FIG. 8). This pivoting may minimize damage to the legless sign stand 123 and/or prevent damage to the undercarriage of the automobile.

Figure 13:
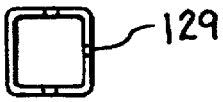
FIG. 13 is a second cross-sectional view of the support mast of the sign supporting mechanism shown in FIG. 10.
Figure 12:
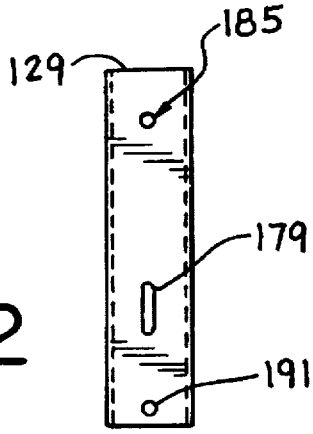
FIG. 12 is a first cross-sectional view of the support mast of the sign supporting mechanism shown in FIG. 10.

FIG. 12 shows a first cross-sectional view of the support mast 129, and FIG. 13 shows a second cross-sectional view of this support mast 129. Each of the two latch apertures 179 are preferably slightly larger than a width of the latch bar 177, and are preferably elongated to allow the latch bar 177 to track therein. A pivot point aperture 191 accommodates the pivot pin 185 (FIG. 11), and a bracket fastening aperture 193 accommodates the bolt 184 for attachment of the sign latch bracket 131 within the support mast 129. FIG. 13 shows that the presently preferred cross-sectional configuration of the support mast 129 is square.

Although exemplary embodiments of the invention have been shown and described, many other changes, modifications and substitutions, in addition to those set forth in the above paragraph, may be made by one having ordinary skill in the art without necessarily departing from the spirit and scope of this invention.

We claim:

1. A legless sign stand for holding a highway traffic sign above a horizontal support surface, comprising:

a rubber base having at least one planar surface;

a rigid planar member contacting the planar surface of the rubber base;

securing means for securing the rigid planar member onto the planar surface of the rubber base; and holding means connected to the rigid planar member, for holding the highway traffic sign above the horizontal support surface in both an upright position for displaying the sign and in a generally horizontal position for storage and transport of the sign, the holding means comprising a support member for supporting the sign, a pivot pin on which the support member is pivotably supported between said upright position and said generally horizontal position, and a retaining member for holding the support member in either of the upright position or the generally horizontal position;

wherein a shear strength of the retaining member is less than a shear strength of the pivot pin, such that when the sign stand is impacted by a vehicle, the retaining member fails in shear, thereby causing the support member to pivot from the upright position to the horizontal position.

2. The legless sign stand according to claim 1, wherein the retaining member comprises a shear bolt.

3. The legless sign stand according to claim 1, wherein the securing means comprises:

at least one planar member aperture in the rigid planar member;

at least one rubber base aperture in the rubber base; and at least one bolt adapted to fit through both the at least one planar member aperture and the at least one rubber base aperture, to thereby secure the rigid planar member onto the planar surface of the rubber base.

4. The legless sign stand according to claim 1, wherein the rigid planar member comprises a metal sheet.

5. The legless sign stand according to claim 1, wherein the retaining member comprises a latch bar.

6. The legless sign stand according to claim 1, further comprising a second rigid planar member contacting a second planar surface of the rubber base.

7. The legless sign stand according to claim 6, wherein the first planar surface of the rubber base comprises an upper surface of the rubber base, and wherein the second planar surface of the rubber base comprises a lower surface of the rubber base.

8. The legless sign stand according to claim 7, wherein the securing means comprises:

at least one planar member aperture in the rigid planar member;

at least one rubber base aperture in the rubber base;

at least one second planar member aperture in the second rigid planar member; and at least one bolt adapted to fit through the planar member aperture, the rubber base aperture, and the second planar member aperture, to thereby secure the two planar members onto the upper and lower surfaces of the rubber base.

9. The legless sign stand according to claim 1, wherein the holding means further comprises two support brackets, each connected to the rigid planar member, the pivot pin being supported between said two support brackets.

10. The legless sign stand according to claim 9, wherein the support member comprises a support mast adapted to be connected to said pivot pin, the support mast accommodating a clamping member therein for clamping onto a portion of the highway traffic sign.

11. A legless sign stand for holding a highway traffic sign above a horizontal support surface, comprising:

a rubber base having at least one planar surface;

a rigid planar member having a plurality of corners and contacting the planar surface of the rubber base, wherein each corner of the rigid planar member is bent down beneath the planar surface of the rubber base and into the rubber base;

securing means for securing the rigid planar member onto the planar surface of the rubber base; and holding means, connected to the rigid planar member, for holding the highway traffic sign above the horizontal support surface.

12. A legless sign stand for holding a highway traffic sign above a horizontal support surface, comprising:

a rubber base having at least one planar surface;

a rigid planar member contacting the planar surface of the rubber base, the rigid planar member having an upper surface and a lower surface;

securing means for securing the rigid planar member onto the planar surface of the rubber base, wherein the securing means comprises a perimeter lip of the rubber base for contacting the upper surface of the rigid planar member; and holding means, connected to the rigid planar member, for holding the highway traffic sign above the horizontal support surface, the holding means comprising a clamping member for clamping onto a portion of the highway traffic sign.

13. The legless sign stand according to claim 12, wherein the securing means further comprises a portion beneath the planar surface of the rubber base for contacting the lower surface of the rigid planar member.

14. The legless sign stand according to claim 13, wherein a perimeter of the rigid planar member is secured between the perimeter lip and the portion beneath the planar surface of the rubber base, the perimeter lip contacting the upper surface of the rigid planar member and the portion beneath the planar surface of the rubber base contacting the lower surface of the rigid planar member.

15. A legless sign stand for holding a highway traffic sign above a horizontal support surface, comprising:

a rubber base having at least one planar surface;

a rigid planar member contacting the planar surface of the rubber base;

securing means for securing the rigid planar member onto the planar surface of the rubber base;

a first support bracket and a second support bracket, each of the first and second support brackets being connected to the rigid planar member;

a support mast adapted to be connected between the first support bracket and the second support bracket, the support mast accommodating a clamping member therein for clamping onto a portion of the highway traffic sign;

a pivot pin connecting the support mast between the two support brackets; and a latch bar for latching the support mast in one of a first position where the support mast is oriented generally perpendicularly relative to the planar surface of the rubber base, and a second position where the support mast is oriented generally parallel to the planar surface of the rubber base;

wherein a shear strength of the pivot pin is greater than a shear strength of the latch bar.

16. The legless sign stand according to claim 15, wherein each of said first and second support brackets has a generally rounded upper surface.

17. The legless sign stand according to claim 16, wherein each of the generally rounded surfaces comprises:

a first notch for accommodating the latch bar when the support mast is latched into the first position; and a second notch for accommodating the latch bar when the support mast is latched into the second position.

18. The legless sign stand according to claim 17, wherein the rounded surface of at least one of the first and second support brackets is asymmetrical about said first notch, having a back stop portion on a side of the first notch opposite to that of the second notch, so that the support mast can only pivot in the direction of the second notch from the first notch.

19. A legless sign stand for holding a highway traffic sign above a horizontal support surface, comprising:

a rubber base;

a rigid member connected to the rubber base;

at least one support bracket connected to the rigid member, the at least one support bracket including a rounded upper surface having a first notch and a second notch thereon;

a support member, operatively connected to the at least one support bracket, for supporting the highway traffic sign;

a latch bar operatively connected to the support member, for holding the support member in one of a first position wherein the support member is oriented generally perpendicularly relative to the horizontal support surface, and a second position wherein the support member is oriented generally parallel to the horizontal support surface;

said first notch accommodating the latch bar when the support member is held in the first position and the second notch accommodating the latch bar when the support member is held in the second position;

wherein the rounded upper surface of the at least one support bracket is asymmetrical about said first notch, having a back stop portion on a side of the first notch opposite to that of the second notch, so that the support member can only pivot in the direction of the second notch from the first notch.

20. The legless sign stand according to claim 19, wherein the at least one support bracket comprises a first support bracket and a second support bracket, and wherein the support member is operatively connected to both the first support bracket and the second support bracket.

21. The legless sign stand according to claim 20, wherein the support member comprises a support mast, the support mast being pivotally connected between the first support bracket and the second support bracket.

22. The legless sign stand according to claim 21, and further comprising a centering plug disposed within said support mast for centering the latch bar.

23. A legless sign stand for holding a highway traffic sign above a horizontal support surface, comprising:

a rubber base having an upper planar surface and a lower planar surface;

a rigid member attached to the rubber base;

two support brackets connected to the rigid member;

a clamping member for clamping onto a portion of the highway traffic sign, the clamping member being operatively connected between the two support brackets, and being movable between an upright orientation generally perpendicular to the upper planar surface of the rubber base, and a storage orientation generally parallel to the upper planar surface of the rubber base;

at least two stacking lugs protruding above the upper planar surface of the rubber base; and a recessed channel, disposed on the lower planar surface of the rubber base, for accommodating the clamping member when the clamping member is in the storage orientation;

wherein the clamping member in the storage orientation does not protrude above a plane formed by top portions of the at least two stacking lugs.

24. The legless sign stand according to claim 23, wherein the two support brackets protrude above the upper planar surface of the rubber base, and wherein a portion of the recessed channel is located beneath the two support brackets on the lower planar surface of the rubber base.

25. The legless sign stand according to claim 24, wherein the legless sign stand assumes a low profile when the clamping member is in the storage orientation, and wherein a second legless sign stand may be stacked upon the legless sign stand, the at least two stacking lugs of the legless sign stand contacting a lower planar surface of the second legless sign stand and the two support brackets of the legless sign stand fitting into a portion of a recessed channel of the second legless sign stand.

* * * * *